US006113123A

United States Patent [19]

Cabanis et al.

[11] Patent Number: 6,113,123

[45] **Date of Patent: *Sep. 5, 2000**

[54] METHOD FOR ASSEMBLING BOOT COMPONENTS TO A CHASSIS OF A SPORTS ARTICLE AND THE BOOT/CHASSIS THUS ASSEMBLED

[75] Inventors: Louis Cabanis, Rumilly; Jean-Louis DeMarchi, Saint-Jorioz, both of France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,630

[22] Filed: Nov. 4, 1997

[30] Foreign Application Priority Data

Nov. 8, 1996 [FR] France ..... 96 13853

[51] Int. Cl.[7] ..... A63C 1/02

[52] U.S. Cl. ..... 280/341; 280/11.3; 36/115

[58] Field of Search ..... 280/7.12, 7.13, 280/7.14, 11.19, 11.22, 11.27, 11.3, 841; 36/115, 43, 44

[56] References Cited

U.S. PATENT DOCUMENTS

| | | | |
|---|---|---|---|
| 2,312,911 | 3/1943 | Jewtraw | 280/11.3 |
| 3,043,600 | 7/1962 | Voakes | 280/7.13 |
| 3,292,940 | 12/1966 | Weitzner | 280/7.13 |
| 3,351,353 | 11/1967 | Weitzner | 280/7.13 |
| 3,494,054 | 2/1970 | Lange | 36/2.5 |
| 4,353,173 | 10/1982 | Paquet | 36/115 |
| 4,835,885 | 6/1989 | Hoshizaki et al. | 36/115 |
| 5,046,746 | 9/1991 | Gierveld | 280/11.22 |
| 5,177,884 | 1/1993 | Rullier | 36/117 |
| 5,397,141 | 3/1995 | Hoshizaki et al. | 280/11.3 |
| 5,452,907 | 9/1995 | Meibock et al. | 280/11.22 |
| 5,566,475 | 10/1996 | Donnadieu | 36/55 |
| 5,570,894 | 11/1996 | Brandner | 280/11.22 |
| 5,855,383 | 1/1999 | Harr et al. | 280/11.22 |

FOREIGN PATENT DOCUMENTS

| | | |
|---|---|---|
| 0416437 | 3/1991 | European Pat. Off. . |
| 0651953 | 5/1995 | European Pat. Off. . |
| 0723744 | 7/1996 | European Pat. Off. . |
| 2668072 | 4/1992 | France . |
| 3043425 | 7/1982 | Germany . |
| 9000384 | 9/1990 | Netherlands . |

*Primary Examiner*—J. J. Swann
*Assistant Examiner*—Frank Vanaman
*Attorney, Agent, or Firm*—Greenblum & Bernstein, P.L.C.

[57] ABSTRACT

A method of assembling a boot to the chassis of a sports article and a boot/chassis assembly so assembled. The boot includes a rigid outer sole and an upper that is at least partially flexible and the method includes mounting the flexible upper on an inner assembly sole by means of a first assembly arrangement, thus forming a first sub-assembly; obtaining a second flexible upper/outer sole sub-assembly by assembling the elements via a second assembly arrangement; obtaining the assembly of the second sub-assembly on the chassis by means of a third assembly arrangement located between the assembly sole and the chassis.

41 Claims, 2 Drawing Sheets

METHOD FOR ASSEMBLING BOOT COMPONENTS TO A CHASSIS OF A SPORTS ARTICLE AND THE BOOT/CHASSIS THUS ASSEMBLED

BACKGROUND OF THE INVENTION

1. Field of the Invention

The instant invention is related to a boot/chassis assembly for a sports article, such as a roller skate or an ice skate, etc., wherein the boot is rigidly connected over its entire length to the chassis of the sports item, and a method of such assembly. According to the method, the boot itself is completely assembled as it is assembled to the chassis.

The invention is more specifically related to assemblies of the type wherein the boot is constituted of a reinforced, though flexible boot, made by a shape-molding apparatus, as opposed to boots constituted of a rigid shell made from a molded plastic material.

2. Description of Background and Relevant Information

A assembly of the aforementioned type is known, for example, by an in-line roller skate marketed under the trade name K2. In this known skate, the boot is constituted of a flexible upper equipped with a smooth outer sole, that is manufactured separately and thereafter affixed via an adhesive by the lower surface of its outer sole onto a rigid outer frame, which is in turn riveted onto a chassis bearing the wheels.

Such an assembly has several disadvantages: there are numerous thicknesses requiring assembly; the outer sole requires assembly to the upper; the boot requires adhesion over the entire surface of its sole onto a rigid frame; the upper of the boot needs to be embedded inside the frame with a view to its adhesion, etc.

Moreover, adhering and riveting the boot on the rigid frame prevents any detachment or adjustment of its position with respect to the chassis.

SUMMARY OF THE INVENTION

It is an object of the present invention to overcome the above-mentioned disadvantages and to provide an assembly and method thereof that solves the above-mentioned problems, mainly by simplifying as much as possible, the assembly/mounting operations of a shape-molded flexible upper onto a chassis, without however, compromising its solidity or the adjustment potential of such an assembly.

This object is achieved by the assembly method according to the invention due to the fact that it comprises the following steps:

- mounting the flexible upper on an inner sole, known as the assembly sole, by means of first assembly means, (such as nails or tacks) thus forming a first subassembly;
- obtaining a second flexible upper/outer sole sub-assembly by assembling the elements via second assembly means (such as rivets);
- obtaining the assembly of the second sub-assembly on the chassis by means of third assembly means (such as nuts/bolts) located between the assembly sole and the chassis.

Indeed, the fact that sub-assemblies are obtained allows the dismantling and adjustment possibilities of the upper with respect to the chassis to be retained.

Moreover, the construction that has been retained comprises fewer thicknesses since, for example, the upper is devoid of the outer sole and is thus less expensive, both in terms of materials and manufacturing duration, as compared to the known construction cited hereinabove.

BRIEF DESCRIPTION OF THE DRAWINGS

The invention will be better understood and other characteristics thereof will become more apparent with the assistance of the following description, provided with reference to the annexed drawings, and illustrating a non-restrictive example of a preferred embodiment, wherein.

DETAILED DESCRIPTION OF THE PREFERRED EMBODIMENTS

Figure 1:
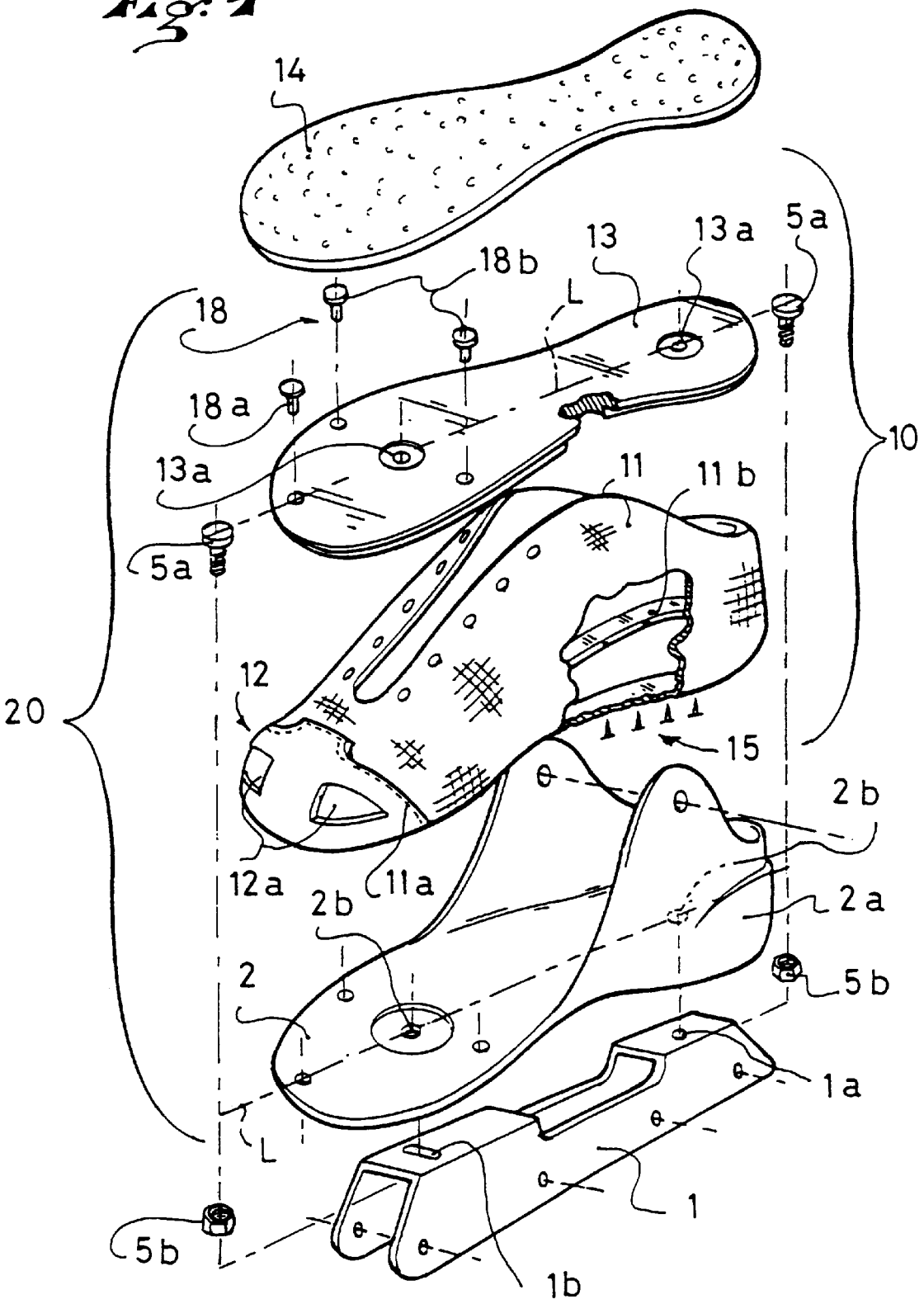
FIG. 1 is an exploded perspective view of a boot/chassis complex according to the invention.
Figure 2:
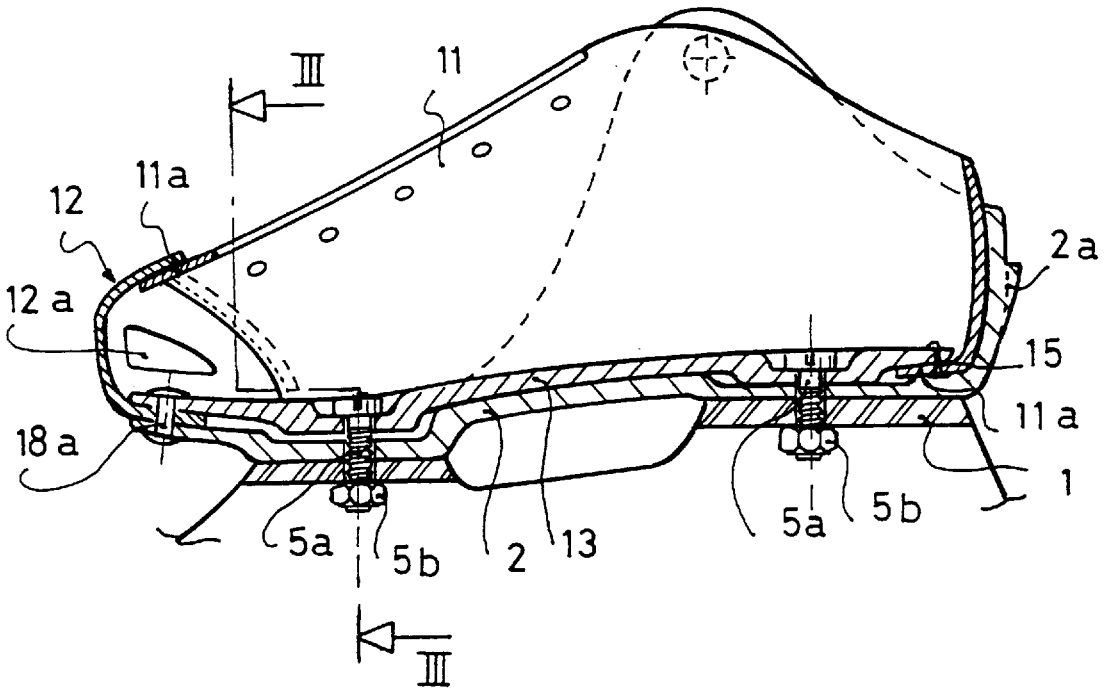
FIG. 2 is a longitudinal sectional view of the complex represented in FIG. 1, after assembly.
Figure 3:
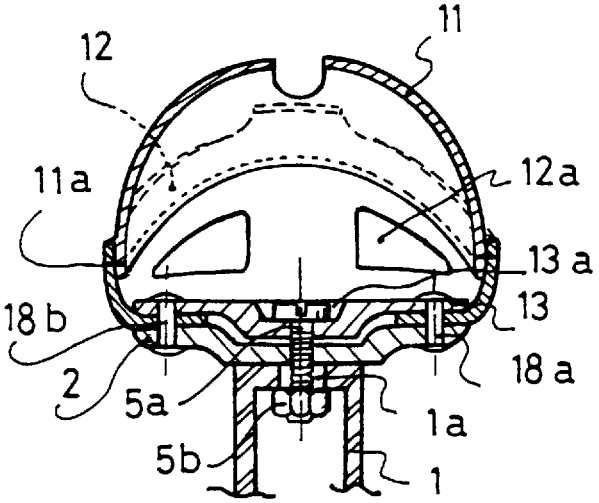
FIG. 3 is a transverse sectional view taken along line III—III of FIG. 2.

FIGS. 1 through 3 represent, in a non-limiting manner, the application of a boot construction according to the invention, to a boot of the in-line roller skate type.

This boot includes:

- a chassis 1 adapted to receive the wheels (not represented in the drawing),
- a rigid boot frame, substantially including:
  - a rigid base 2 that defines both the sole portion of the boot that is adapted to be connected to chassis 1, and a heel reinforcement 2*a* originating from the base and capable of receiving a stiff journalled collar adapted to surround the user's heel, but that has not been represented in the drawing;
- a flexible boot portion, or sub-assembly 10 substantially including:
  - an upper 11 (in the drawing, the non-limiting illustrated embodiment happens to represent a low upper), equipped with an joining piece 12, the joining piece 12 including ventilation holes 12*a;*
  - an assembly sole 13;
- an inner detachable sole 14, also known as the insole, the sole being added after the complex has been manufactured.

The sub-assembly 10 constituting the flexible boot portion of a sports article is made in a traditional manner by shaping it around a mold representing the volume of the foot to be shod.

First, the upper 11 is made from different materials such as textile or leather, selected on the basis of breathability and retention, these various materials. including joining piece 12, being assembled together by stitches 11*a*.

The sub-assembly constituted in this mariner is mounted, after the shaping of the heel zone, onto a mold whilst defining a peripheral return 11*b*, and is assembled to the assembly sole 13 via a first assembly connection in the form of nails or tacks 15 arranged peripherally along the entire length of the return 11*b*, at the lower portion of the upper.

The upper 11 can also be fixed to the assembly sole by adhesives arranged between the peripheral return 11*b* and the assembly sole 13.

The sub-assembly 10, or first sub-assembly constituted in this manner is thereafter assembled to the rigid base 2, by a second assembly connection in the form of rivets 18, in this case three rivets 18*a*, 18*b*, so as to define a second sub-assembly 20.

The three rivets are arranged according to a triangular configuration, the first rivet 18*a* being located in the area of the front end of sub-assembly 20 and the two other rivets being located at the ends of a transverse line corresponding substantially to the metatarsal-phalangeal journal of the foot. Thus, the rivets 18 only secure the front of the inner sole 13 to the rigid base 2. The boot is completely assembled only as the inner sole is secured, at front and back, to the chassis, as described immediately following.

The second sub-assembly 20 is then assembled to the chassis by means of two screw 5*a*—nut 5*b* systems, arranged along the longitudinal axis L of a third assembly connection in the form of the boot, respectively at the front and rear ends thereof.

As represented specifically in FIG. 1, each screw 5*a* is first introduced into an associated hole 13*a* of the assembly sole, such hole 13*a* being provided with a countersink for the housing of the screw head, and then it passes successively into an associated hole 2*b* of base 2, and a hole 1*a*, 1*b* of chassis 1.

This provides the detachable assembly of the boot portion 20 to chassis 1, thus allowing the boot and/or chassis to be changed should either of them become deteriorated. At the same time, the screws 5*a* are used to assemble the flexible upper portion 10 to the rigid base 2 by pinching the base between the assembly sole 13 and the rigid chassis 1.

Moreover, the hole 1*b* for the passage of the connecting screw 5*a* at the front end of the skate is designed to have an oblong shape in the transverse direction so as to enable an angular adjustment of the longitudinal axis L of the boot with respect to the longitudinal axis of the chassis, so that it is morphologically adapted to the user's foot.

This type of adjustment can be done very easily, and in fact, the screws 5*a* need only be slightly loosened to make the sub-assembly 20 pivot in the oblong slot 1*b* about the screw located at the level of the heel. This pivoting is facilitated by the sub-assembly 20 constituted previously.

The assembly according to the invention thus offers the following advantages:

The possibility of adjusting the boot sub-assembly 20 with respect to chassis 1.

The assembly facilitated by the use of rivets/screws instead of adhesives. This assembly is particularly advantageous as regards the connection of the flexible upper 10 to the rigid base 2. Indeed, if such an assembly is obtained traditionally by adhesion, then it is always delicate and arbitrary due to the difference in stiffness between the various elements that require assembly.

Good stiffness in torsion and in a longitudinal direction.

Optimization of the positioning of the anchoring points located, on the one hand, near the forefoot where the most substantial torsional forces are generated and, on the other hand, in a longitudinal direction, so that the boot is assembled to the chassis along its entire length.

The elimination of one assembly thickness, with respect to a construction of a known type, because at the most, only three thicknesses are assembled at each time. As such, the screws obtain the assembly of the chassis, base and the assembly sole, whereas the rivets obtain the assembly of the assembly sole, the upper (or joining piece) and the rigid base. Such an elimination of one assembly thickness is especially important because the assembly of multiple thicknesses, especially via adhesion, becomes even more difficult if there are a large number of thicknesses.

The elimination of a shape-molding operation in the area of the upper by designing a previously molded rigid joining piece that is assembled directly onto the upper.

Better ventilation in the area of the rigid joining piece due to the absence of any material originating from the upper beneath said joining piece and elimination of over-thicknesses at this level.

The possibility of using a less expensive plastic material for the construction of the plastic joining piece as compared to a thermohardenable material, because the joining piece does not require shape-molding.

The elimination of the adhesion operation of the upper on the rigid base. such an operation being complicated, arbitrary and requiring the use of compatible materials.

What is claimed is:

1. A method of assembling boot components to a chassis of a sports article, said boot components including at least a rigid outer sole, an upper that is at least partially flexible, and an inner assembly sole, said method comprising:

assembling said inner assembly sole to said upper by means of a first assembly means, thereby forming a first sub-assembly;

assembling said first sub-assembly to said rigid outer sole by means of a non-adhesive second assembly means, thereby forming a second sub-assembly, said second assembly means being positioned only within the following: an area substantially corresponding to, and forwardly of, a metatarsal-phalangeal journal of a user's foot;

assembling said second sub-assembly to said chassis by means of a third assembly means.

2. A method according to claim 1, wherein:

said assembling said first sub-assembly to said rigid outer sole comprises extending fastening elements through said inner assembly sole, through said upper, and through said rigid outer sole.

3. A method according to claim 1, wherein:

said second assembly means consist of discrete fastening elements.

4. A method according to claim 1, wherein:

said third assembly means comprise dismantleable assembly means extending substantially along a longitudinal axis of said second sub-assembly.

5. A method according to claim 1, wherein:

said first assembly means comprises an adhesive.

6. A method according to claim 1, further comprising:

placing an insole upon said inner assembly sole.

7. A method of assembling boot components to a chassis of a sports article, said boot components including at least a rigid outer sole, an upper that is at least partially flexible, and an inner assembly sole, said method comprising:

assembling said inner assembly sole to said upper by means of a first assembly means, thereby forming a first sub-assembly;

assembling said first sub-assembly to said rigid outer sole by means of a non-adhesive second assembly means, thereby forming a second sub-assembly;

assembling said second sub-assembly to said chassis by means of a third assembly means;

said second assembly means consisting of discrete elements arranged at a front end of said second sub-assembly and along a substantially transverse line corresponding to a metatarsal-phalangeal journal of a user's foot.

8. A method according to claim 7, wherein:

said third assembly means comprise dismantleable assembly means extending substantially along a longitudinal axis of said second sub-assembly.

9. A method according to claim 7, wherein:

said discrete elements are rivets.

10. A method of assembling boot components to a chassis of a sports article, said boot components including at least a rigid outer sole, an upper that is at least partially flexible, and an inner assembly sole, said method comprising:

assembling said inner assembly sole to said upper by means of a first assembly means, thereby forming a first sub-assembly;

assembling said first sub-assembly to said rigid outer sole by means of a second assembly means, thereby forming a second sub-assembly, said second assembly means being positioned only within the following: an area substantially corresponding to, and forwardly of, a metatarsal-phalangeal journal of a user's foot;

assembling said second sub-assembly to said chassis by means of a third assembly means.

11. A method according to claim 10, wherein:

said assembling said first sub-assembly to said rigid outer sole comprises extending fastening elements through said inner assembly sole, through said upper, and through said rigid outer sole.

12. A method according to claim 10, wherein:

said second assembly means consisting of discrete fastening elements.

13. A method according to claim 10, wherein:

said third assembly means comprise dismantleable assembly means extending substantially along a longitudinal axis of said second-subassembly.

14. A method according to claim 10, wherein:

said first assembly means comprises an adhesive.

15. A method according to claim 10, further comprising:

placing an insole upon said inner assembly sole.

16. A method of assembling boot components to a chassis of a sports article, said boot components including at least a rigid outer sole, an upper that is at least partially flexible, and an inner assembly sole, said method comprising:

assembling said inner assembly sole to said upper by means of a first assembly means, thereby forming a first sub-assembly;

assembling said first sub-assembly to said rigid outer sole by means of a second assembly means, thereby forming a second sub-assembly, said second assembly means being positioned only within the following: an area substantially corresponding to, and forwardly of, a metatarsal-phalangeal journal of a user's foot and forwardly of said area;

assembling said second sub-assembly to said chassis by means of a third assembly means;

said second assembly means consisting of discrete elements arranged at a front end of said second sub-assembly and along a substantially transverse line corresponding to a metatarsal-phalangeal journal of a user's foot.

17. A method according to claim 16, wherein:

said third assembly means comprise dismantleable assembly means extending substantially along a longitudinal axis of said second-subassembly.

18. A method according to claim 16, wherein:

said discrete elements are rivets.

19. An assembly of a boot and a chassis of a sports article, said assembly comprising:

an at least partially flexible upper having a peripheral lower portion;

an inner assembly sole, said inner assembly sole being assembled to said peripheral lower portion of said upper by a first assembly connection, thereby creating an upper/inner sole sub-assembly;

a rigid outer sole, said upper/inner sole sub-assembly being assembled to said rigid outer sole by a second assembly connection, thereby creating an upper/inner sole/outer sole sub-assembly, said second assembly connection being non-adhesive, said second assembly connection being positioned only within the following: an area substantially corresponding to and forwardly of, a metatarsal-phalangeal journal of a user's foot; and a chassis, said inner sole being connected to said chassis by a dismantleable third assembly connection.

20. An assembly according to claim 19, wherein:

said dismantleable third assembly connection comprises a plurality of screws.

21. An assembly according to claim 19, wherein:

said dismantleable third assembly connection comprises dismantleable fastening elements extending substantially along a longitudinal axis of said upper/inner sole sub-assembly.

22. An assembly according to claim 19, wherein:

said first assembly connection comprises an adhesive.

23. An assembly according to claim 19, further comprising:

an arrangement for adjusting a position of said upper/inner sole/outer sole subassembly with respect to said chassis.

24. An assembly according to claim 23, wherein:

said arrangement comprises at least one elongated slot extending transverse to a longitudinal axis of said chassis, said dismantleable third assembly connection cooperating with said slot.

25. An assembly according to claim 23, wherein:

said dismantleable third assembly connection comprises a plurality of screws; and said arrangement comprises at least one elongated slot extending transverse to a longitudinal axis of said chassis, at least one of said screws extending through said slot, said screw being tightenable in one of a plurality of transverse positions within said slot.

26. An assembly according to claim 19, wherein:

said second assembly connection comprises fastening elements extending through said inner assembly sole, through said upper, and through said rigid outer sole.

27. An assembly of a boot and a chassis of a sports article, said assembly comprising:

an at least partially flexible upper having a peripheral lower portion;

an inner assembly sole, said inner assembly sole being assembled to said peripheral lower portion of said upper by a first assembly connection, thereby creating an upper/inner sole sub-assembly;

a rigid outer sole, said upper/inner sole sub-assembly being assembled to said rigid outer sole by a second assembly connection, thereby creating an upper/inner sole/outer sole sub-assembly, said second assembly connection being non-adhesive; and a chassis, said inner sole being connected to said chassis by a dismantleable third assembly connection;

said second assembly connection consisting of discrete elements arranged at a front end of said second sub-assembly and along a substantially transverse line corresponding to a metatarsal-phalangeal journal of a user's foot.

28. An assembly according to claim 27, wherein:

said dismantleable third assembly connection comprises dismantleable fastening elements extending substantially along a longitudinal axis of said upper/inner sole sub-assembly.

29. An assembly according to claim 27, wherein:

said discrete elements are rivets.

30. An assembly of a boot and a chassis of a sports article, said assembly comprising:

an at least partially flexible upper having a peripheral lower portion;

an inner assembly sole, said inner assembly sole being assembled to said peripheral lower portion of said upper by a first assembly connection, thereby creating an upper/inner sole sub-assembly;

a rigid outer sole, said upper/inner sole sub-assembly being assembled to said rigid outer sole by a second assembly connection, thereby creating an upper/inner sole/outer sole sub-assembly, said second assembly connection being positioned only within the following: an area substantially corresponding to, and forwardly of, a metatarsal-phalangeal journal of a user's foot; and a chassis, said inner sole being connected to said chassis by a dismantleable third assembly connection.

31. An assembly according to claim 30, wherein:

said dismantleable third assembly connection comprises a plurality of screws.

32. An assembly according to claim 30, wherein:

said dismantleable third assembly connection comprises dismantleable fastening elements extending substantially along a longitudinal axis of said upper/inner sole sub-assembly.

33. A method according to claim 30, wherein:

said second assembly means consisting of discrete fastening elements.

34. An assembly according to claim 30, wherein:

said first assembly connection comprises an adhesive.

35. An assembly according to claim 30, further comprising:

an arrangement for adjusting a position of said upper/inner sole/outer sole subassembly with respect to said chassis.

36. An assembly according to claim 35, wherein:

said arrangement comprises at least one elongated slot extending transverse to a longitudinal axis of said chassis, said dismantleable third assembly connection cooperating with said slot.

37. An assembly according to claim 35, wherein:

said dismantleable third assembly connection comprises a plurality of screws; and said arrangement comprises at least one elongated slot extending transverse to a longitudinal axis of said chassis, at least one of said screws extending through said slot, said screws being tightenable in one of a plurality of transverse positions within said slot.

38. An assembly according to claim 30, wherein:

said second assembly connection comprises fastening elements extending through said inner assembly sole, through said upper, and through said rigid outer sole.

39. An assembly of a boot and a chassis of a sports article, said assembly comprising:

an at least partially flexible upper having a peripheral lower portion;

an inner assembly sole, said inner assembly sole being assembled to said peripheral lower portion of said upper by a first assembly connection, thereby creating an upper/inner sole sub-assembly;

a rigid outer sole, said upper/inner sole sub-assembly being assembled to said rigid outer sole by a second assembly connection, thereby creating an upper/inner sole/outer sole sub-assembly, said second assembly connection being positioned only in, or forwardly of, an area substantially corresponding to a metatarsal-phalangeal journal of a user's foot and forwardly of said area, said second assembly connection consisting of discrete elements arranged at a front end of said second sub-assembly and along a substantially transverse line corresponding to a metatarsal-phalangeal journal of a user's foot; and a chassis, said inner sole being connected to said chassis by a dismantleable third assembly connection.

40. An assembly according to claim 39, wherein:

said dismantleable third assembly connection comprises dismantleable fastening elements extending substantially along a longitudinal axis of said upper/inner sole sub-assembly.

41. An assembly according to claim 39, wherein:

said discrete elements are rivets.

* * * * *